US007179095B1

(12) United States Patent
Peng et al.

(10) Patent No.: US 7,179,095 B1
(45) Date of Patent: Feb. 20, 2007

(54) MATRIX BOARD-TO-BOARD CONNECTOR ASSEMBLY

(75) Inventors: Yung-Chi Peng, Tucheng (TW); Chung-Hsin Huang, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 11/305,075

(22) Filed: Dec. 19, 2005

(30) Foreign Application Priority Data

Jan. 24, 2005 (TW) ..... 94201281 U

(51) Int. Cl.
*H01R 12/00* (2006.01)

(52) U.S. Cl. ..... 439/74; 439/290

(58) Field of Classification Search ..... 439/74, 439/83, 284, 290, 291, 695
See application file for complete search history.

(56) References Cited

U.S. PATENT DOCUMENTS 3,440,596 A * 4/1969 Frompovicz ..... 439/695
5,876,219 A * 3/1999 Taylor et al. ..... 439/74
6,183,268 B1 * 2/2001 Consoli et al. ..... 439/74
6,193,537 B1 * 2/2001 Harper et al. ..... 439/291
6,379,170 B1 * 4/2002 Czeschka et al. ..... 439/291
6,443,745 B1 * 9/2002 Ellis et al. ..... 439/101
6,699,048 B2 * 3/2004 Johnson et al. ..... 439/74
6,805,278 B1 * 10/2004 Olson et al. ..... 228/180.22
6,918,776 B2 * 7/2005 Spink, Jr. ..... 439/74
6,926,538 B2 * 8/2005 Ma ..... 439/74

* cited by examiner

*Primary Examiner*—Thanh-Tam Le
(74) *Attorney, Agent, or Firm*—Rosenberg, Klein & Lee

(57) ABSTRACT

A matrix board-to-board connector includes a receptacle connector having a first housing with a plurality of first contacts received therein and a plug connector having a second housing with a plurality of second contacts received therein. The first contact has a middle-connecting portion, two touching pins and at least one first soldering leg. The second contact has a touching portion, two guiding pins and at least one second soldering leg. The first contact extends between the two guiding pins of the second contact, the touching portion of the second contact is inserted between the two touching pins of the first contact, and the two touching pins clip the touching portion of the second contact.

8 Claims, 6 Drawing Sheets

MATRIX BOARD-TO-BOARD CONNECTOR ASSEMBLY

BACKGROUND OF THE INVENTION

1. Field of the Invention

The present invention relates to a board-to-board connector assembly and, more particularly to a matrix board-to-board connector assembly.

2. The Related Art

A board-to-board connector assembly includes a plug connector and a receptacle connector respectively soldered on a circuit board. The plug connector and the receptacle connector are connected mechanically and electrically with each other through the engagement between the contacts of the two connectors. With the trend of miniaturization of electronic devices, the density between the contacts of the connectors increases greatly, therefore the matrix board-to-board connector arises.

An electrical connector assembly for interconnecting a pair of circuit boards in parallel spaced-apart planes comprising first and second connectors is disclosed in U.S. Pat. No. 5,876,219 issued on Mar. 2, 1999. The first connector includes a dielectric first housing having a mating face and an array of first contacts exposed along the mating face. Each first contact has a base portion and tow contact posts extended from the corresponding base potion. The first housing has a shroud that defines a boundary around the array of first contacts. The shroud has an edge at a height above the mating face and the first contacts are recessed below the edge. The second connector includes a dielectric second housing having a mating face and an array of second contacts exposed along the mating face for mating with the first contacts. The second contacts are in tabulate shape. The second housing is configured for complementary reception within the boundary of the shroud, wherein the shroud serves to align the first and second housings for mating before engagement of the first and second contacts can occur. In assembly of the first connector and the second connector, the first contacts are embraced in the shroud. The tabulate second contacts are inserted and positioned between the two contact posts of the first contacts, therefore the first connector and the second connector is electrically connected.

However, in assembly, as the second contacts are in tabulate shape, it is easy for the contact posts of the first contacts to be damaged by the second contacts duo to failing to align the first contacts and the second contacts, especially when the density of the two kinds of contacts is too high, the first contacts are much prone to be destroyed.

Hence, an improved board-to-board connector is required to overcome the aforementioned disadvantage of the prior art.

SUMMARY OF THE INVENTION

Accordingly, an object of the present invention is to provide a matrix board-to-board connector assembly that is constructed to prevent contacts of the board-to-board connector from being damaged even there is a little misalignment between the contacts during assembling.

To fulfill the above object, in accordance with the present invention, a board-to-board connector assembly is provided. The board-to-board connector assembly includes a receptacle connector, which comprises a first housing with a plurality of first contacts. The first housing has a first base planar board with a plurality of first opening recesses disposed therein arranged in a matrix array. Each first opening recess extends transversely and has a first contact received therein. The board-to-board connector assembly further includes a plug connector having a second housing with a plurality of second contacts set therein. A plurality of second opening recesses is disposed in the second housing arranged in a matrix array too. Each second opening recess has a transverse recess and a longitudinal recess crossing the transverse recess. Each second contact is received in the corresponding longitudinal recess. Each first contact has a middle-connecting portion, two touching pins extended abreast from one end of the middle-connecting portion and at least one soldering leg extended from one opposite end of the middle-connecting portion. Each second contact has a touching portion, tow guiding pins extended abreast from one end of the touching portion and at least one second soldering leg extended from one opposite end of the touching portion. When the receptacle connector and the plug connector are mated, the two guiding pins of the second contact guide the first contact extending therebetween and guide the two touching pins of a first contact inserting in the transverse recess of the second opening recess. Simultaneously, the touching portion of a second contact is inserted between two touching pins of a first contact and the two touching pins clip the touching portion of a second contact, therefore, the receptacle connector and plug connector are connected mechanically and electrically.

According to the invention, in the course of mating the first contact and the second contact, the two touching pins of the first contact are guided and protected by the two guiding pins of the second contact. Thus the contacts are protected from being damaged even there is a little misalignment between the contacts during assembling.

The object, features and advantages of the present invention will be clearly understood through a consideration of the following detailed description.

Figure 1:
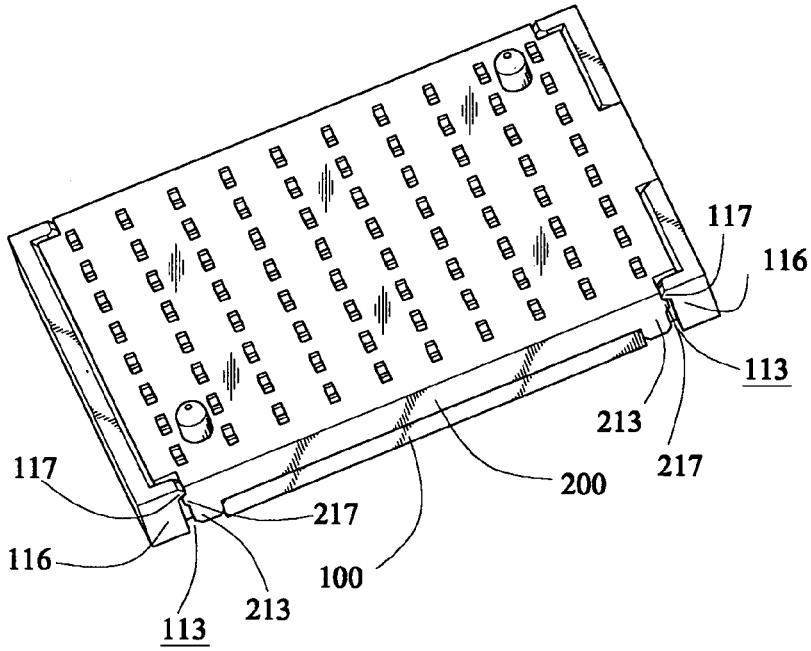
FIG. 1 is an assembled perspective view of a presently preferred embodiment of a matrix board-to-board connector assembly including a receptacle connector and a plug connector.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE PREFERRED EMBODIMENT

Figure 2:
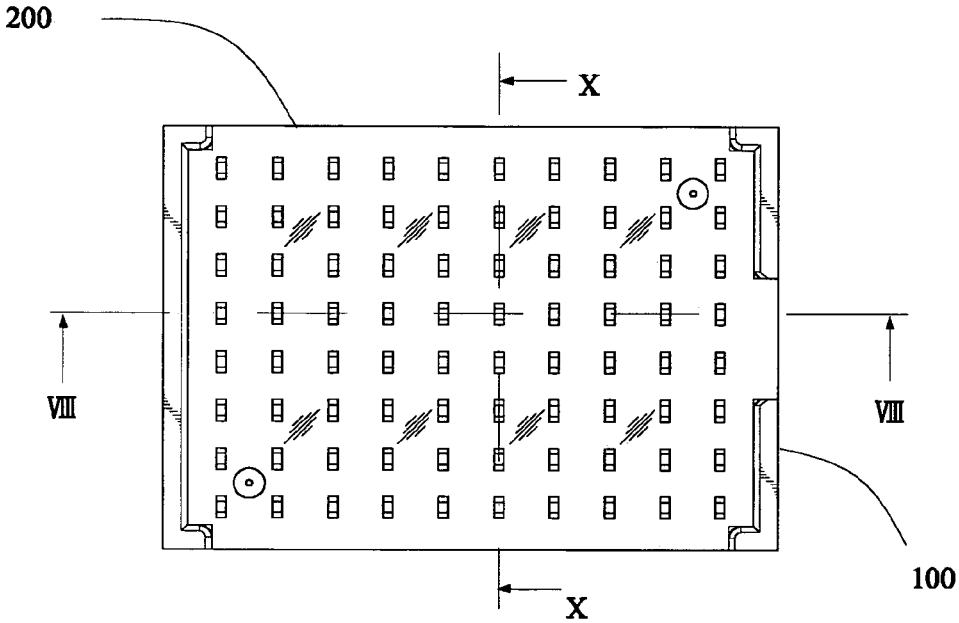
FIG. 2 is a top plan view of the matrix board-to-board connector assembly of FIG. 1.

There is shown in FIG. 1 and FIG. 2 a matrix board-to-board connector assembly comprising a receptacle connector 100 and a plug connector 200, respectively being soldered with a circuit board (not shown). The receptacle connector 100 is engaged with the plug connector 200, whereby the two circuit boards are connected mechanically and electrically.

Figure 3:
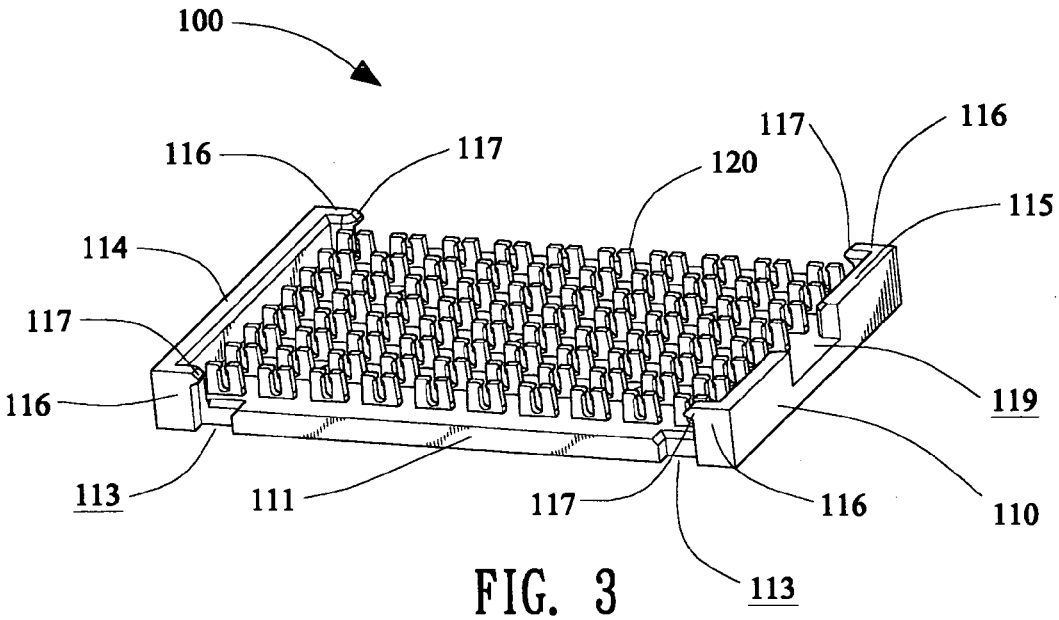
FIG. 3 is a perspective view of the receptacle connector of the matrix board-to-board connector assembly shown in FIG. 1.
Figure 12:
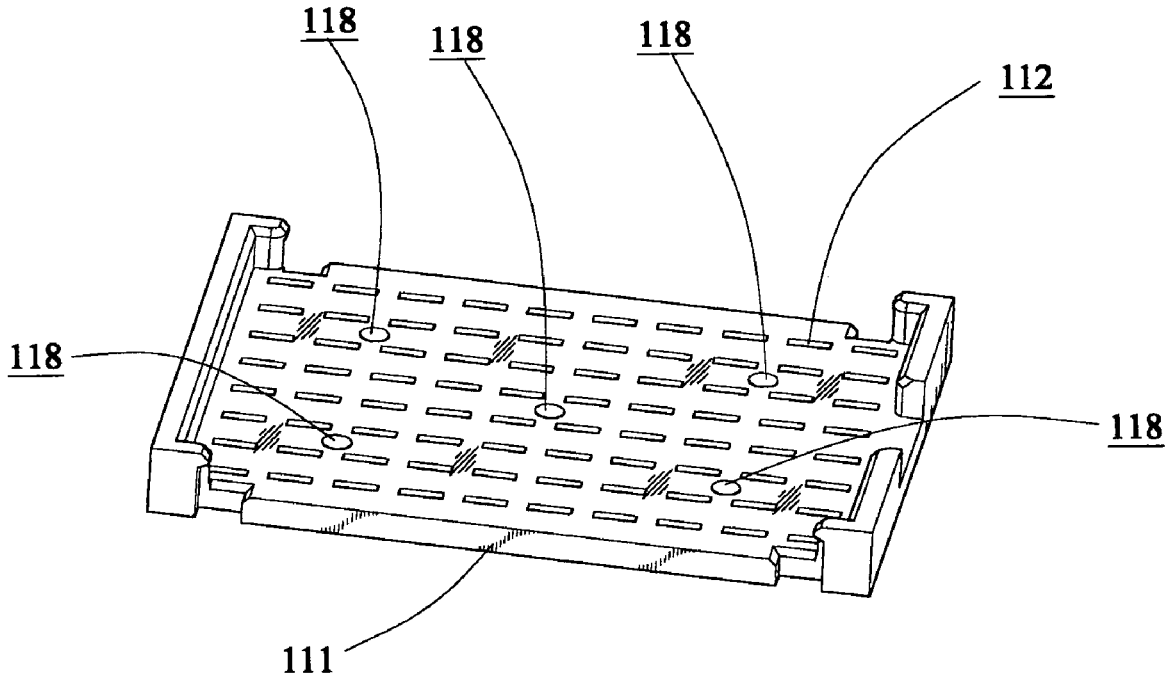
FIG. 12 is a perspective view of a first housing for the receptacle connector shown in FIG. 3.

With reference to FIG. 3, the receptacle connector 100 has a first housing 110 with a plurality of first contacts 120 embedded therein. The first housing 110 has a first base planar board 111 with the corresponding number of first opening recesses 112 (shown in FIG. 12) set thereon for receiving the first contacts 120. Each corner of the first housing 110 has a groove 113 set thereof. A first sidewall 114 and a second sidewall 115 respectively extend upwardly from the left and right side of the first base planar board 111. Positioning arms 116 are further protruded from the both ends of the first sidewall 114 and the second sidewall 115 along the front and back lengthwise sides of the first housing 110. The first sidewall 114 and the second sidewall 115 and the positioning arms 116 define an accommodation space to receive a plug connector 200. First retaining protrusions 117 are formed on the front end of the positioning arms 116 for retaining the plug connector 200.

Figure 4:
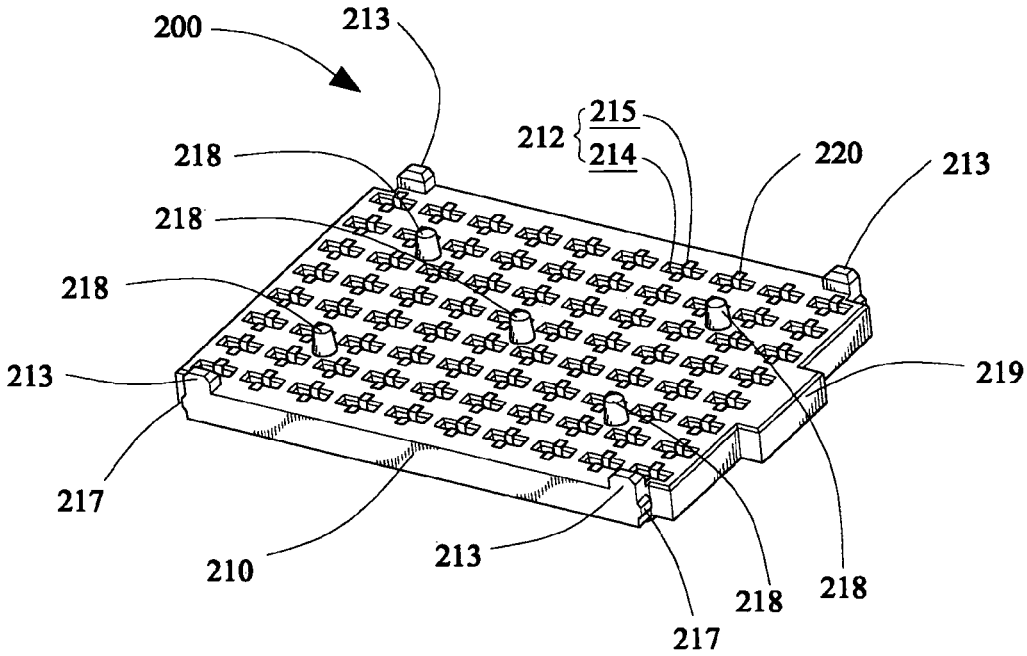
FIG. 4 is a perspective view of the plug connector of the matrix board-to-board connector assembly shown in FIG. 1.

With reference to FIG. 4, the plug connector 200 comprises a second housing 210 and a plurality of second contacts 220 configured in the second housing 210. The second housing 210, which looks like a board, includes the corresponding number of second opening recesses 212 according to the number of the second contacts 220. Each second opening recess 212 comprise a transverse recess 214 for receiving a first contact 120 therein (described later), and a longitudinal recess 215, which is perpendicular to the corresponding transverse recess 214, for a second contact 220 to be inserted therein. Each corner of the plug connector 200 upwardly extends a positioning leg 213 with a second retaining protrusion 217 protruded horizontally towards the outside of the plug connector 200. In assembly, the positioning legs 213 of the second housing 210 are respectively received in the grooves 113 of the first housing 110 with each second retaining protrusion 217 for engagement with the corresponding first retaining protrusion 117 of the first housing 110.

Figure 5:
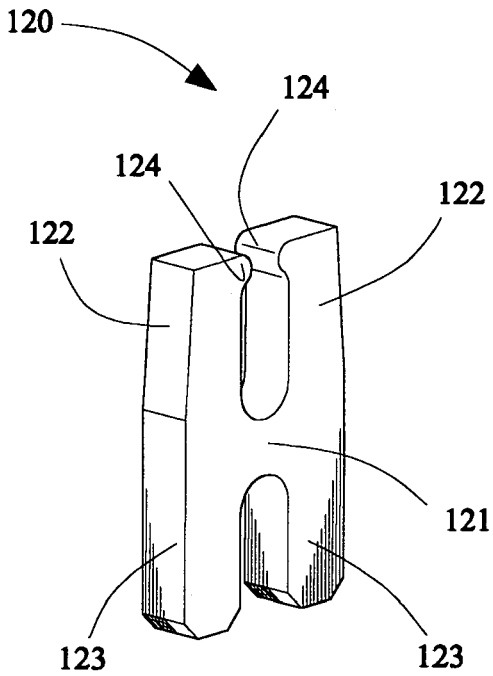
FIG. 5 is a perspective view of a first contact for the receptacle connector shown in FIG. 3.

Referring to FIG. 5, each first contact 120 comprises a middle-connecting portion 121, one end of which upwardly extends a pair of touching pins 122 and the other end of which downwardly extends a pair of first soldering legs 123. Each touching pins 122 has a protrusion 124 formed on the inside surface thereof. The distance between the two protrusions 124 is smaller than the thickness of a second contact 220.

Figure 8:
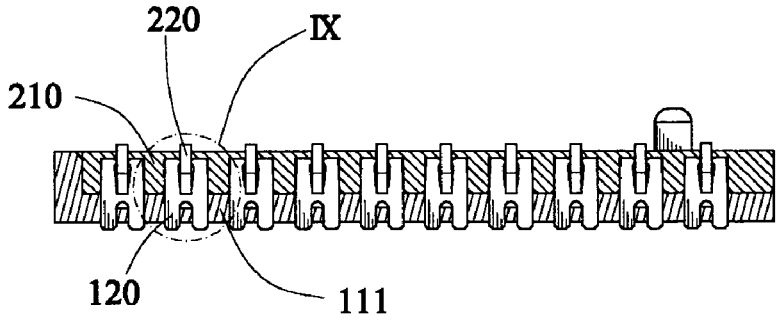
FIG. 8 is a cross-sectional view taken along line VIII—VIII of FIG. 2.
Figure 9:
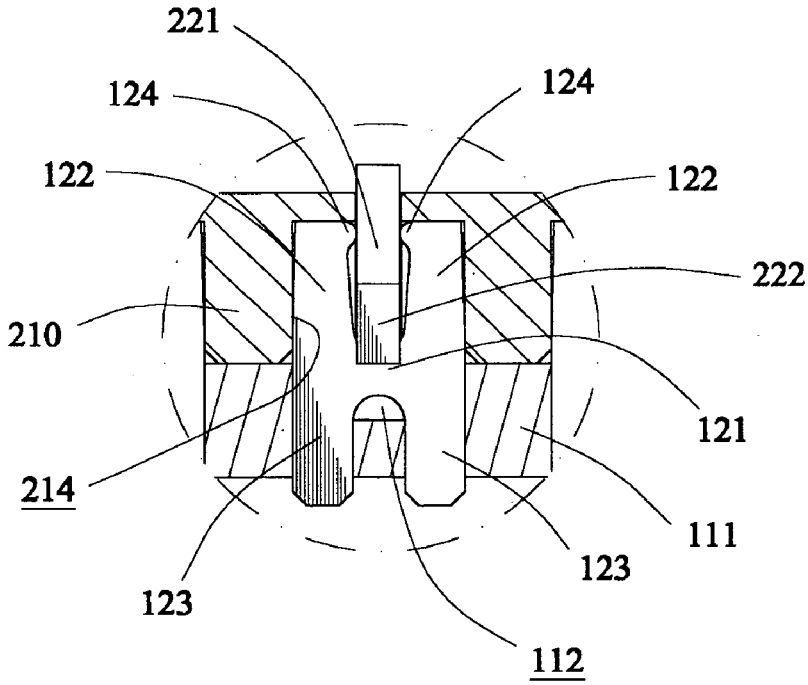
FIG. 9 is an enlarged view of a circled part that is labeled by IX in FIG. 8.

Please further refer to FIG. 8 and FIG. 9. Each middle-connecting portion 121 is fixedly positioned in the corresponding first opening recess 112 of the receptacle connector 100. The touching pin 122 of each first contact 120 extend out of the top surface of the first base planar board 111 of the receptacle connector 100. In assembly, the touching pins 122 are inserted in the corresponding transverse recesses 214 of the corresponding second opening recess 212 of plug connector 200. The first soldering legs 123 extend out of the bottom surface of the first base planar board 111 of the receptacle connector 100 and solder with a circuit board (not shown) by means of Surface Mount Technology (SMT). It is convenient for the first contacts 120 to absorb tin due to extending the first contacts 120 having the first soldering legs 123 extending downward, whereby the soldering force between the first contacts 120 and the circuit board is enhanced, otherwise there is some space between the two first soldering legs 123, therefore air could move freely to make the first soldering legs 123 being heated fast and evenly so as to be well soldered with the circuit board.

Figure 6:
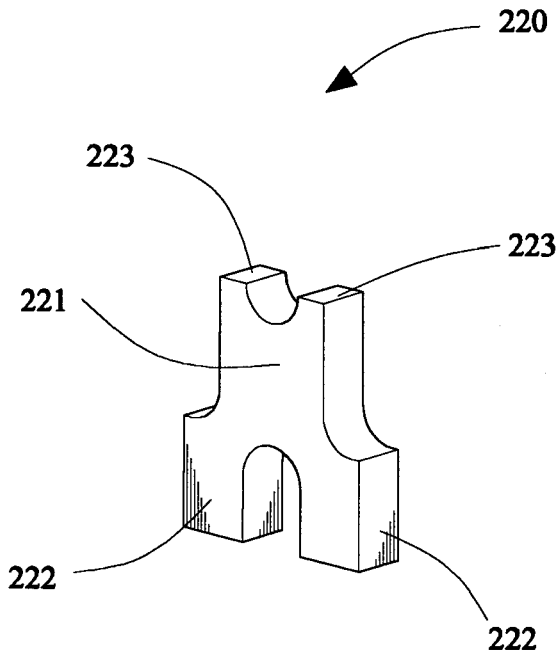
FIG. 6 is a perspective view of a second contact for the plug connector shown in FIG. 3.
Figure 7:
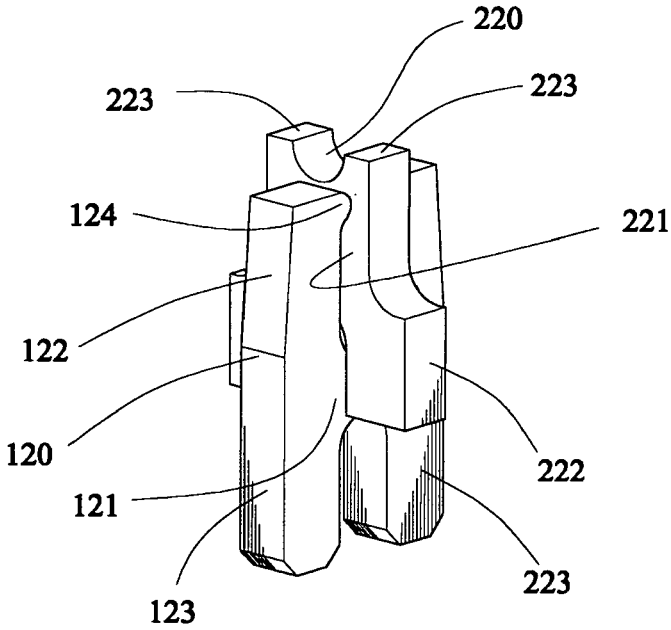
FIG. 7 illustrates the mating of the first contact of the receptacle connector and the second contact of the plug connector.
Figure 10:
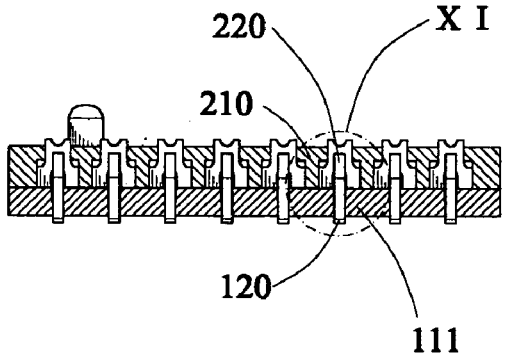
FIG. 10 is a cross-sectional view taken along line X—X of FIG. 2.
Figure 11:
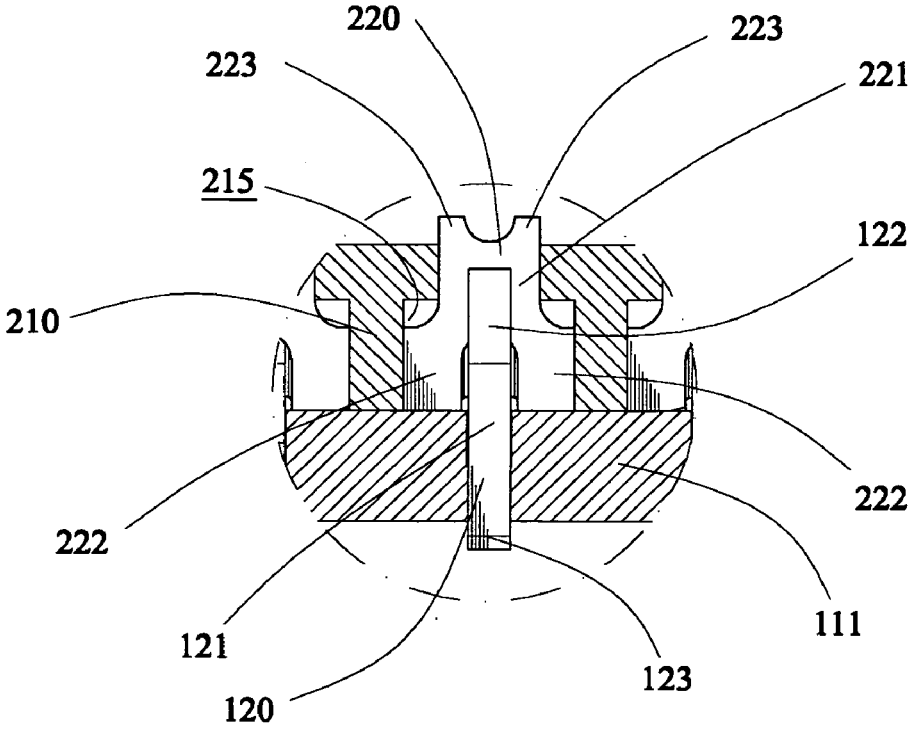
FIG. 11 is an enlarged view of a circled part that is labeled by XI in FIG. 10.

With reference to FIG. 6, each second contact 220 comprises a touching portion 221, which extends two guiding pins 222 perpendicularly downwardly and two second soldering legs 223 perpendicularly upwardly. The distance between the two guiding pins 222 is a little bigger than the thickness of the first contact 120. Please further refer to FIGS. 4,10 and 11. The guiding pins 222 are received in the corresponding longitudinal recesses 215 of the corresponding second opening recesses 212 of the second housing 210. The second soldering legs 223 extend out of the bottom of the second housing 210 to be soldered with another circuit board (not shown).

Please refer to FIGS. 7 to 11. When the receptacle connector 100 is assembled with the plug connector 200, the touching pins 122 of the first contacts 120 are inserted in the corresponding transverse recesses 214 of the corresponding second opening recesses 212 of the plug connector 200. The guiding pins 222 of the corresponding second contacts 220 guide the corresponding touching pins 122 to be received between the corresponding guiding pins 222. It is obvious that each first contact 120 is retained fixedly with the corresponding second contact 220 because the guiding pins 222 of the first contact 120 embrace the second contact 220 and the touching pins 122 of the first contact 120 embrace the second contact 220. Otherwise the protrusions 124 of each first contact 120 abut the corresponding second contact 220, so that the first contact 120 is engaged with the second contact 220 fixedly.

A plurality of through holes 118 as shown in FIG. 4 is disposed on the first base planar board 111 of the receptacle connector 100 in order to reliably solder a plurality of first contacts 120 on the receptacle connector 100 for that there are so many first contacts 120 disposed on the receptacle connector 100. When the first contacts 120 are being soldered on the receptacle connector 100, it is convenient for the first contacts 120 to be heated evenly and fast, therefore the first contacts 120 can be retained reliably on the receptacle connector 100. In the assembly of the receptacle connector 100 and the plug connector 200, a plurality of guiding posts 218 (shown in FIG. 4) configured on the second housing 210 of the plug connector 200 is received in the corresponding through holes 118, so that the receptacle connector 100 is engaged tightly with the plug connector 200.

There is a foolproof groove 119 (shown in FIG. 3) formed in the substantially middle part of the second sidewall 115 of the first housing 110 of the receptacle connector 100 for accommodating a foolproof protrusion 219 (shown in FIG. 4) extended from the corresponding part of the second housing 210 of the plug connector 200. Therefore, the receptacle connector 100 is prevented from being wrongly assembled with the plug connector 200.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A matrix board-to-board connector assembly for interconnecting a pair of circuit boards in parallel spaced-apart planes, the assembly comprising:

a receptacle connector including a first housing with a plurality of first contacts received therein, the first housing having a first base planar board, the first base planar board having a matrix array of first opening recesses configured therein, each first opening recess extending transversely, said first contacts being secured in a respective one of said first opening recesses, each of said first contacts having a middle-connecting portion, two touching pins and at least one first soldering legs said two touching pins extending from one end of said middle-connecting portion, said first soldering leg extending from an opposite end of said middle-connecting portion; and a plug connector including a second housing with a plurality of second contacts received therein, the second housing having a matrix array of second opening recesses configured therein, each of said second opening recesses having a transverse recess and a longitudinal recess crossing the transverse recess, each of said second contacts being retained in a corresponding longitudinal recess, each of said second contacts having a touching portion, two guiding pins and at least one second soldering leg, said two guiding pins extending from one end of said touching portion, said second soldering leg extending from an opposite end of said touching portion, wherein a distal end of each of said guiding pins extends no further than flush with said corresponding second opening recesses;

wherein when the receptacle connector and the plug connector are mated, said touching pins on each of said first contacts are orthogonally received between the two guiding pins of a corresponding one of said second contacts so that said guiding pins of said second contacts are located on opposing sides of said middle-connecting portion of said first contacts and said touching pins of said first contacts engage opposing sides of said touching portion of said second contacts in mechanical contact therewith said two touching pins being inserted into the transverse recess of the corresponding one of said second opening recesses.

2. The matrix board-to-board connector assembly as claimed in claim 1, wherein two protrusions are formed on the inner surface of said touching pins of said first contact, the two protrusions abut against the touching portion of said second contact.

3. The matrix board-to-board connector assembly as claimed in claim 1, wherein said first contact has two first soldering legs, said second contact has two second soldering legs.

4. The matrix board-to-board connector assembly as claimed in claim 1 wherein at least one through hole is set on the first base planar board of said receptacle connector.

5. The matrix board-to-board connector assembly as claimed in claim 4, wherein said second housing of said plug connector has at least one guiding post for extending into said at least one through hole.

6. The matrix board-to-board connector assembly as claimed in claim 1, wherein two sidewalls are extended perpendicularly from two opposite sides of the first base planar board of said receptacle connector, one of the sidewalls defines a foolproof groove, a foolproof protrusion is formed on said second housing of said plug connector for engagement with said foolproof groove.

7. The matrix board-to-board connector assembly as claimed in claim 1, wherein said first base planar board defines several grooves in edges thereof, said second housing has several positioning legs extending perpendicularly from edges thereof for inserting into the corresponding grooves.

8. The matrix board-to-board connector assembly as claimed in claim 1, wherein a first sidewall and a second sidewall extend perpendicularly from the left and right sides of said first base planar board, said first sidewall and said second sidewall respectively further extend along the front and back sides of said first base planar board to form positioning arms, first retaining protrusions are formed on ends of said positioning arms, said second housing forms second retaining protrusions for engaging with the first retaining protrusions.

* * * * *